US008275151B2

(12) United States Patent
Caramma

(10) Patent No.: US 8,275,151 B2
(45) Date of Patent: Sep. 25, 2012

(54) SPEAKERPHONE USING ADAPTIVE PHASE ROTATION

(75) Inventor: Marcello Caramma, Berkshire (GB)

(73) Assignee: Agere Systems Inc., Allentown, PA (US)

( * ) Notice: Subject to any disclaimer, the term of this patent is extended or adjusted under 35 U.S.C. 154(b) by 1273 days.

(21) Appl. No.: 11/959,923

(22) Filed: Dec. 19, 2007

(65) Prior Publication Data

US 2009/0161904 A1 Jun. 25, 2009

(51) Int. Cl.
*H04R 1/40* (2006.01)

(52) U.S. Cl. ..... 381/97; 381/56; 381/58; 381/59

(58) Field of Classification Search ..... 381/97, 381/89, 104–107, 56, 58, 59
See application file for complete search history.

(56) References Cited

U.S. PATENT DOCUMENTS 4,097,689 A * 6/1978 Yamada et al. ..... 381/310
4,348,644 A * 9/1982 Kamiya ..... 330/297
4,857,778 A * 8/1989 Hague ..... 327/555
5,253,298 A * 10/1993 Parker et al. ..... 381/13
6,160,449 A * 12/2000 Klomsdorf et al. ..... 330/149
6,166,598 A * 12/2000 Schlueter ..... 330/127
7,013,117 B2 * 3/2006 Darabi ..... 455/240.1
2002/0070803 A1 * 6/2002 Rzyski ..... 330/149
2003/0198356 A1 * 10/2003 Thompson ..... 381/92

OTHER PUBLICATIONS

Martin Wolters, "*State of the Art Speech Processing for Broadcasting*", Speech NAB_99, Cleveland, Ohio ,1999, pp. 1-7.

* cited by examiner

*Primary Examiner* — Kimberly D Nguyen
*Assistant Examiner* — Duy T Nguyen
(74) *Attorney, Agent, or Firm* — Mendelsohn, Drucker & Associates, P.C.; David L. Cargille; Steve Mendelsohn

(57) ABSTRACT

An improved speakerphone for a cellular telephone, portable telephone handset, or the like. In one embodiment, a receiver provides an audio signal, and a first phase-shifter phase-shifts the audio signal by a first phase-shift amount. A second phase-shifter phase-shifts the audio signal by a second phase-shift amount and drives a loudspeaker. A processor sets the first phase-shift amount to each one of a plurality of phase-shift amounts and determines a corresponding average-to-peak ratio value of the first phase-shifted audio signal. The processor then selects one of the plurality of phase-shift amounts having a corresponding average-to-peak ratio value that meets at least one criteria (e.g., the largest one of the average-to-peak ratio values), and then sets the second phase-shift amount to be the same as the selected phase-shift amount. This enhances the perceived loudness of sound from loudspeaker.

21 Claims, 4 Drawing Sheets

Caramma 1

SPEAKERPHONE USING ADAPTIVE PHASE ROTATION

TECHNICAL FIELD

The present invention relates to telephone handset devices, and, in particular, to speakerphones used in telephone handsets or the like.

BACKGROUND

Loudspeakers have been added to cellular and portable telephone handsets to allow for more than one person to listen to a telephone conversation and/or provide for "hands-free" ("speakerphone") operation of the telephone handset. Unfortunately, when the loudspeaker (transducer) in the telephone handset is used to reproduce a human voice, the perceived loudness or volume of the voice may be too low for noisy environments (e.g., in a moving car) and, to compensate, a user may increase the volume control for the loudspeaker so much that the voice becomes distorted. The lack of loudness stems from the human voice having a low average-to-peak amplitude ratio (i.e., the peak amplitude of the voice signal is significantly greater than the average amplitude of the voice signal), the relatively small size of the loudspeaker (typically ~1 cm. across), and/or the limited power capability of the amplifier driving the loudspeaker (e.g., to increase battery life).

One common approach to improve the perceived loudness of a voice signal from the loudspeaker is to compress and/or clip the audio signal prior to amplification to increase the average-to-peak amplitude ratio of the audio signal. However, the compression and clipping can increase the distortion of the voice signal from the loudspeaker, possibly reducing intelligibility.

SUMMARY

In one embodiment, the present invention is a method in which an audio signal is produced from a received signal. For each phase-shift amount of a plurality of phase-shift amounts, the audio signal is phase-shifted by the phase-shift amount in a first phase-shifter, and a corresponding average/peak ratio value of the phase-shifted audio signal from the first phase-shifter is determined. One of the plurality of phase-shift amounts is selected as having a corresponding average/peak ratio value that meets at least one criteria. The audio signal is phase-shifted using a second phase-shifter by an amount substantially the same as the selected phase-shift amount, and the phase-shifted audio signal from the second phase-shifter is coupled to a transducer.

In another embodiment, the present invention is an apparatus comprising a receiver, first and second phase shifters, and a processor. The receiver is adapted to provide an audio signal at an output. The first phase-shifter is adapted to phase-shift the audio signal by a first phase-shift amount, and the second phase-shifter is adapted to phase-shift the audio signal by a second phase-shift amount and apply the second phase-shifted audio signal to a transducer. The processor is adapted to 1) set the first phase-shift amount to each one of a plurality of phase-shift amounts and determine a corresponding average/peak ratio value of the first phase-shifted audio signal, 2) select one of the plurality of phase-shift amounts having a corresponding average/peak ratio value that meets at least one criteria, and 3) set the second phase-shift amount to be substantially the same as the selected one of the plurality of phase-shift amounts.

BRIEF DESCRIPTION OF THE DRAWINGS

The aspects, features, and advantages of the present invention will become more fully apparent from the following detailed description, the appended claims, and the accompanying drawings in which like reference numerals identify similar or identical elements.

DETAILED DESCRIPTION

Figure 1:
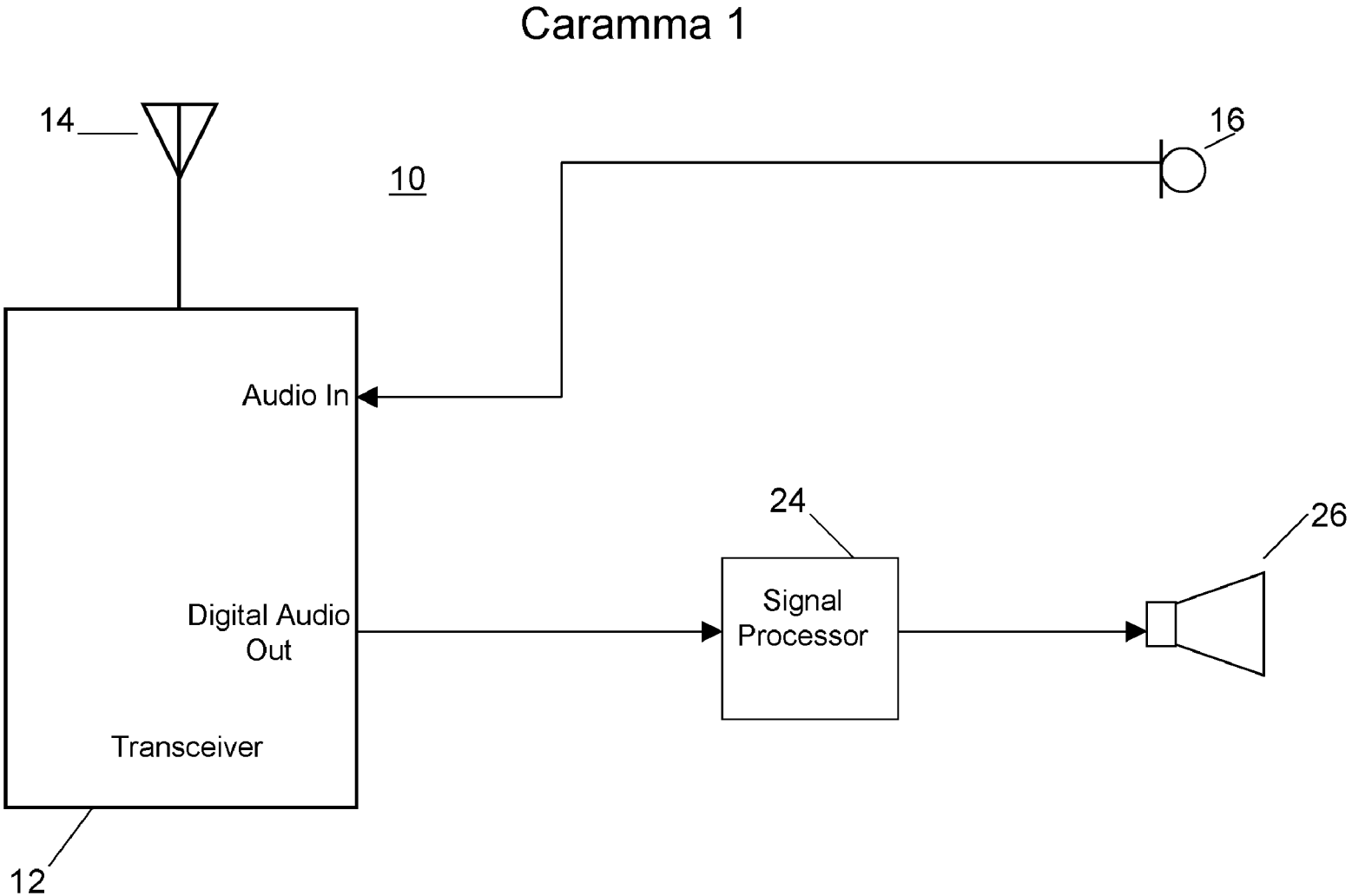
FIG. 1 is a simplified block diagram of a cellular or portable telephone handset with speakerphone capability according to one exemplary embodiment of the present invention.

Referring to FIG. 1, an exemplary embodiment of the invention is shown, in which a simplified block diagram of a cellular or portable telephone handset 10 having speakerphone capability is shown. The handset 10 has therein a transmitter/receiver combination (transceiver) 12, a microphone 16, a signal processor 24, and a transducer, such as a loudspeaker 26. The transceiver 12 comprises a low-power transmitter, a receiver, and a controller. The transceiver 12 is designed to communicate with a cellular network (not shown) for a cellular telephone application or with a base station (not shown) for a portable telephone application. The transceiver 12 is shown having an input, Audio In, which accepts an audio signal from microphone 16 for transmission by the transmitter portion of the transceiver 12. The transceiver 12 is also shown having a digital audio output, Digital Audio Out, coming from the receiver portion of the transceiver 12. The signal processor 24 processes digital audio signals from the receiver portion of the transceiver 12, converts the processed digital audio signals into analog audio signals, and amplifies the analog audio signals to drive loudspeaker 26. The signal processor 24 is typically controlled by a processor (not shown) in the transceiver 12 but may operate independently thereof. Further, the processor 24 may be integrated into the transceiver 12. The transducer 26 may be an earpiece for non-speakerphone applications or a loudspeaker for speakerphone applications, as will be explained in more detail below.

Figure 2:
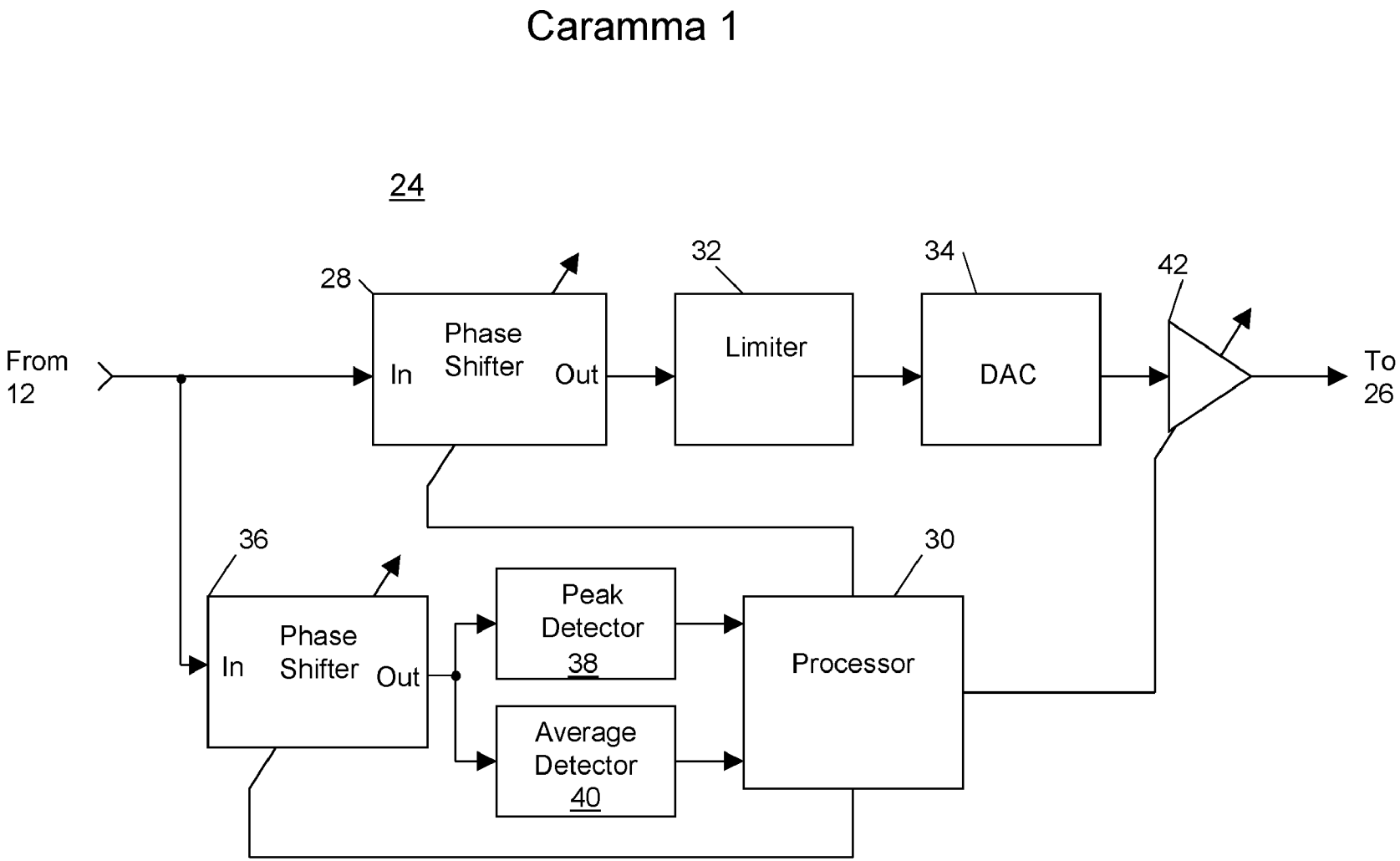
FIG. 2 is a simplified block diagram of a signal processor for use in the telephone handset of FIG. 1.

FIG. 2 shows an exemplary implementation of the signal processor 24 of FIG. 1. The digital audio signals from the output of the receiver portion of the transceiver 12 (FIG. 1) are coupled to a phase-shifter 28. In this example and as will be explained in more detail below, the phase-shifter 28 provides up to 32 different discrete phase-shifts to the digital audio signals from transceiver 12 under control of a processor 30. (As used herein and as will be explained in more detail below, the term "phase-shift" means one or more frequency-dependent signal phase-shifts provided by a phase-shifter having a programmable transfer function that may be implemented in an analog or a digital embodiment.) Phase-shifted signals from phase-shifter 28 may be limited (compressed and/or clipped) by optional limiter 32. Limiter 32, here a conventional "soft" limiter, keeps the amplitude of the phase-shifted signals from exceeding a known level to avoid overloading subsequent stages and generating more distortion than from the limiting effect of limiter 32 alone. In a digital embodiment of the invention, the limited signals from limiter 32 are converted to analog signals by digital-to-analog converter 34, and the analog signals are amplified by a variable gain amplifier 42, also under control of the processor 30. For non-speakerphone applications, the gain of the amplifier is reduced to keep sound from the transducer 12 from becoming excessively loud and injuring a user's hearing. For an all-analog implementation of the signal processor 24 (where the audio output signals of the transceiver 12 are analog, not digital, audio signals), the DAC 34 is not present.

The digital audio signals from the output of the receiver portion of the transceiver 12 (FIG. 1) are also coupled to a phase-shifter 36. The phase-shifter 36 is substantially similar to the phase-shifter 28 and provides up to 32 different discrete phase-shifts to the digital audio signals from transceiver 12 under control of the processor 30. The phase-shifted audio signals from shifter 36 are processed by a conventional peak detector 38 and a conventional average detector 40. The peak detector 38 generates a value indicating the peak value of the phase-shifted audio signals from shifter 38, and the average detector 40 generates a value indicating the average value of the phase-shifted audio signals. The processor 30, responsive to the detectors 38 and 40, calculates an average-to-peak ratio value for the phase-shifted audio signals. As will be explained in more detail below, the processor 30 varies the phase-shift by the phase-shifter 36 and tracks the corresponding calculated average-to-peak ratio values of the phase-shifted audio signals for the various phase-shifts by phase-shifter 36. If a particular phase-shift by phase-shifter 36 results in an average-to-peak ratio values that meets at least one criteria (e.g., is greater than a specified threshold value or is the largest of the tracked average-to-peak ratio values), then that phase-shift is duplicated in phase-shifter 28, and the processor repeats the varying of the phase-shift by shifter 36, tracking of the corresponding calculated average-to-peak ratio values for the different phase-shifts, etc.

Figure 3:
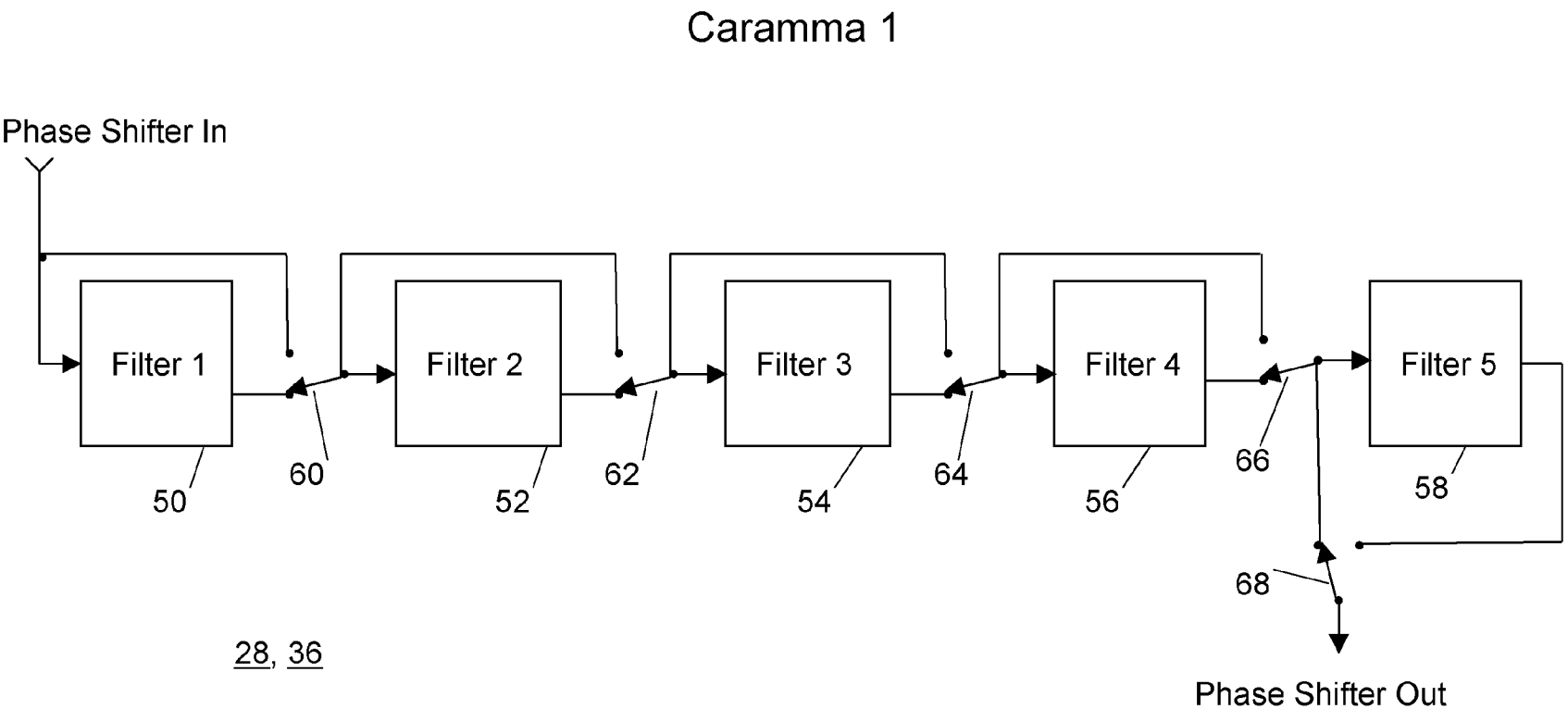
FIG. 3 is an exemplary embodiment of a programmable phase-shifter for use in the signal processor of FIG. 2.

An exemplary embodiment of the phase-shifter 28 and the phase-shifter 36 is shown in FIG. 3. The phase-shifter 28, 36 has, in this example, five conventional unity-gain, first-order, all-pass filters 50-58 selectively coupled in series by switches 60-68 that are controlled by the processor 30 (FIG. 2). For purposes here, each first-order filter 50-58 applies to an input signal thereto a frequency-dependent phase-shift of approximately 0 to approximately $\pi$ radians. Moreover, each filter has a different center or crossover frequency (the frequency at which the phase-shift by the filter is approximately one-half the maximum phase-shift, here $\pi/2$ radians). The center frequencies are chosen to at least partially span the bandwidth of the audio signals from the transceiver 12 (typically 300-3000 Hz in telephonic applications). Exemplary center frequencies of the filters 50-58 are 500 Hz, 700 Hz, 900 Hz, 1100 Hz, and 1300 Hz, respectively. Higher-order all-pass filters may be used for filters 50-58.

In a digital implementation of the filters 50-58, each filter has a first-order transfer function of the form $H_x(z)=((z^{-1}-a_x)/(1-a_x z^{-1}))$, where x=1, . . . , 5. Assuming a sampling frequency of 8 kHz, exemplary approximate values of $a_x$ for the filters 50-58 having the above center frequencies are $a_1=0.6682$, $a_2=0.5600$, $a_3=0.4610$, $a_4=0.3689$, and $a_5=0.3689$. In this example, if the switches 60-68 are all set to bypass the filters 50-58, then the transfer function of the phase-shifter 28, 36 is unity (no phase-shift). If all the switches 60-68 are set such that all the filters 50-58 are serially coupled (cascaded), then the phase-shifter 28, 36 has a transfer function of a fifth-order all-pass filter: $((z^{-5}-2.3402z^{-4}+2.1440z^{-3}-0.9604z^{-2}+0.2101z^{-1}-0.0179)/(1-2.304z^{-1}+2.1440z^{-2}-0.9604z^{-3}+0.2101z^{-4}-0.0179z^{-5})$, using the values given above for each filter. The switches 60-68 are switched by processor 30 using, in this example, a Gray code sequence so that no more than one filter 50-58 is switched in or out at any given time.

The structures of the phase-shifter 28 and the phase-shifter 36 are, in this example, substantially the same but they may be different so long as the different structures produce substantially the same phase-shifts. For example, the structure of phase-shifter 36 can be conventional multiple-order all-pass filter (e.g., a fifth-order all-pass filter) having programmable coefficients that essentially duplicate the transfer function of the multi-stage, single-order all-pass filter structure shown in FIG. 3.

Figure 4:
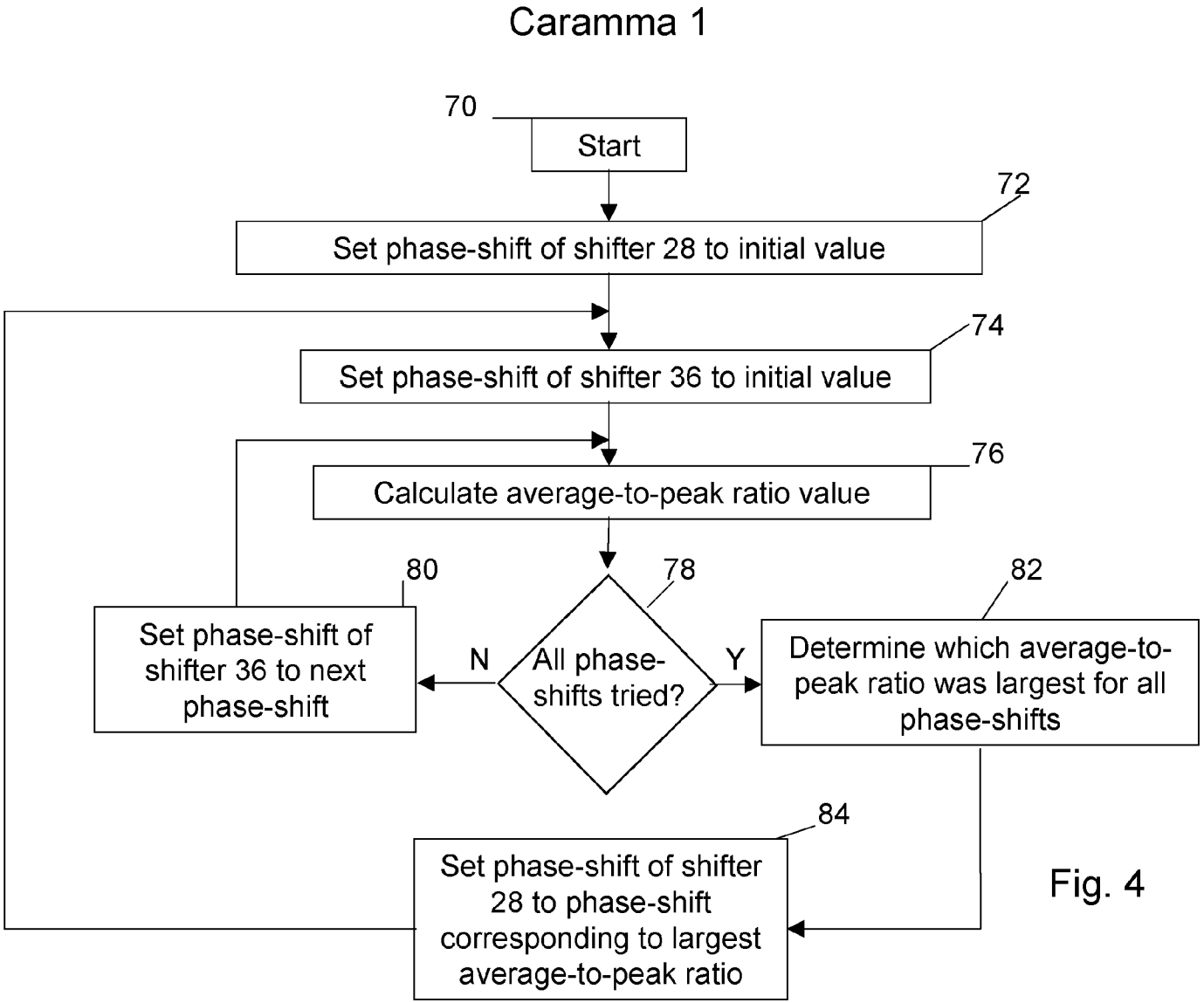
FIG. 4 is an exemplary flow chart illustrating operation of the signal processor shown in FIG. 2.

Exemplary operation of the signal processor 24 (FIG. 2) is shown in FIG. 4. Beginning with step 70, the processor 30 in steps 72 and 74 sets the phase-shift of phase-shifters 28 and 36 to an initial value (e.g., no phase-shift by setting the switches 60-68 (FIG. 3) to bypass all of the filters 50-58). The average-to-peak ratio value from the peak and average values produced by detectors 38 and 40, respectively, is calculated in step 76. The processor 30 then sequences through all the remaining possible phase-shifts (31 in this embodiment) of phase-shifter 36 by sequencing through all of the remaining switch position combinations of the switches 60-68 (FIG. 3) in steps 76-80. The calculated average-to-peak ratio values for each of the possible phase-shifts by phase-shifter 36 are stored by the processor and, in step 82, the processor determines (selects) the largest of the average-to-peak ratio values. Then, in step 84, the processor sets the phase-shift by phase-shifter 28 (by configuring the switches in phase-shifter 28) to the phase-shift by phase-shifter 36 that yielded the selected average-to-peak ratio value. The processor 30 then repeats the above-described process beginning with step 74. Thus, the processor 30 determines the average-to-peak ratio of the phase-shifted audio signals for each of the possible phase-shifts by phase-shifter 36 and sets the phase-shift of the phase-shifter 28 to the phase-shift that resulted in the largest average-to-peak ratio value.

Alternatively, at step 82, the processor 30 selects an average-to-peak ratio value that is greater than a specified threshold amount and, in step 84, sets the phase-shift by the phase-shifter 28 to the phase-shift by phase-shifter 36 that produced the selected average-to-peak ratio.

To keep the processor 30 from changing the phase-shift by phase-shifter 28 excessively, hysteresis may be added to step 84 so that the phase-shift will not be changed unless the selected average-to-peak ratio value changes by more than a given amount from an earlier selected average-to-peak ratio value.

It is understood that the processor 30 need only try a subset of the possible phase-shifts by phase-shifter 36 in steps 76-80.

By having the processor 30 in the signal processor 24 sequence though at least some of the possible phase-shifts by phase-shifter 36, the phase-shift that yields the largest (or greater than a specified threshold value) average-to-peak ratio value is applied to an audio signal that drives the transducer/loudspeaker 26 (FIG. 1). This results in an increase in the perceived loudness of the voice signal from the loudspeaker. Although the audio signal may change over time, because the processor 30 continually tries different phase-shifts and updates the phase-shift of the audio signal to the loudspeaker accordingly, the signal processor 24 adapts to the changing audio signal and provides the proper phase-shift to the audio signal as it changes.

Although the present invention has been described in the context of average-to-peak ratio values, it will be understood that the invention could also be implemented using the reciprocal peak-to-average ratio values with appropriate changes in the logic. In particular, if a first criterion were the average-to-peak ratio value being greater than a specified threshold value, then the corresponding reciprocal first criterion would be the peak-to-average ratio value being less than the specified threshold value. Similarly, if a second criterion were the largest average-to-peak ratio value, then the corresponding reciprocal second criterion would be the smallest peak-to-average ratio value. As used in the claims, unless context dictates otherwise, the term "average/peak ratio value" will be understood to cover either an average-to-peak ratio value or a peak-to-average ratio value, where a generic version of the first criterion is the average/peak ratio traversing a specified threshold value (where the term "traversing" means "greater than" for average-to-peak ratio values and "less than" for peak-to-average ratio values) and a generic version of the second criterion is the extreme average/peak ratio (where the term "extreme" means "largest" for average-to-peak ratio values and "smallest" for peak-to-average ratio values).

While this embodiment is a speakerphone application, the inventive technique may be used for non-speakerphone voice applications, e.g., when the telephone 10 (FIG. 1) operates as a conventional handset (where transducer 26 is used as an earpiece), etc.

It is generally desirable that the functional blocks shown are implemented in an all-digital form. Advantageously, all of the digital circuitry of the cellular or portable telephone handset 10 may be implemented in one or more programmable digital processors or fixed logic devices, such as microprocessors, digital signal processors (DSP), programmable logic devices (PLD), gate arrays, etc. Further, all of the circuitry of the cellular or portable telephone handset may be implemented in a mixed-signal integrated circuit, where the digital circuitry is implemented as stated above and the analog circuitry implemented in the integrated circuit separate from the digital circuitry.

Although the present invention has been described in the context of a cellular or portable telephone handset, those skilled in the art will understand that the present invention can be implemented in the context of other types of telecommunication systems.

For purposes here, signals and corresponding nodes, ports, inputs, or outputs may be referred to by the same name and are interchangeable. Also, for purposes of this description and unless explicitly stated otherwise, each numerical value and range should be interpreted as being approximate as if the word "about" or "approximately" preceded the value of the value or range. Further, reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the terms "implementation" and "example."

Also for purposes of this description, the terms "couple," "coupling," "coupled," "connect," "connecting," or "connected," refer to any manner known in the art or later developed in which a signal is allowed to be transferred between two or more elements and the interposition of one or more additional elements is contemplated, although not required. Conversely, the terms "directly coupled," "directly connected," etc., imply the absence of such additional elements.

It is understood that various changes in the details, materials, and arrangements of the parts which have been described and illustrated in order to explain the nature of this invention may be made by those skilled in the art without departing from the scope of the invention as expressed in the following claims.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

The invention claimed is:

1. A method comprising:

a) producing an audio signal from a received signal;

b) for each phase-shift amount of a plurality of phase-shift amounts, phase-shifting the audio signal by the phase-shift amount in a first phase-shifter and determining a corresponding average/peak ratio value of the phase-shifted audio signal from the first phase-shifter;

c) selecting one of the plurality of phase-shift amounts having a corresponding average/peak ratio value that meets at least one criteria;

d) phase-shifting the audio signal using a second phase-shifter by an amount substantially the same as the selected phase-shift amount; and e) coupling the phase-shifted audio signal from the second phase-shifter to a transducer.

2. The method of claim 1, wherein the at least one criteria is the corresponding average/peak ratio value traversing a specified threshold value.

3. The method of claim 1, wherein the at least one criteria is the corresponding average/peak ratio value being an extreme one of the corresponding average/peak ratio values.

4. The method of claim 1, wherein step e) comprises the steps of:

e1) amplitude limiting the shifted audio signal from the second phase-shifter;

e2) amplifying the amplitude limited audio signal; and e3) coupling the amplified audio signal to the transducer.

5. The method of claim 1, wherein the first phase-shifter comprises a plurality of fixed phase-shifters selectively coupled in different combinations to provide the plurality of phase-shift amounts.

6. The method of claim 5, wherein the fixed phase-shifters are all-pass filters having different center frequencies.

7. The method of claim 5, wherein the fixed phase-shifters are first-order all-pass filters.

8. The method of claim 5, wherein:

the first phase-shifter uses a unique combination of the fixed phase-shifters to provide each one of the plurality of phase-shift amounts; and the two combinations of the fixed phase-shifters used to provide each sequential pair of phase-shift amounts differ by one fixed phase-shifter.

9. The method of claim 1, wherein the first phase-shifter comprises an all-pass filter programmable to provide the plurality of phase-shift amounts.

10. The method of claim 1, wherein the first and second phase-shifters have substantially identical structures.

11. The method of claim 1, wherein, for each phase-shift amount, step b) comprises the steps of:

b1) determining a peak value of the phase-shifted audio signal from the first phase-shifter;

b2) determining an average value of the phase-shifted audio signal from the first phase-shifter; and b3) determining the average/peak ratio value based on the determined peak and average values.

12. An apparatus comprising:

a receiver adapted to provide an audio signal at an output;

a first phase-shifter adapted to phase-shift the audio signal by a first phase-shift amount;

a second phase-shifter adapted to phase-shift the audio signal by a second phase-shift amount and apply the second phase-shifted audio signal to a transducer; and a processor adapted to 1) set the first phase-shift amount to each one of a plurality of phase-shift amounts and determine a corresponding average/peak ratio value of the first phase-shifted audio signal, 2) select one of the plurality of phase-shift amounts having a corresponding average/peak ratio value that meets at least one criteria, and 3) set the second phase-shift amount to be substantially the same as the selected one of the plurality of phase-shift amounts.

13. The apparatus of claim 12, wherein the at least one criteria is the corresponding average/peak ratio value traversing a specified threshold value.

14. The apparatus of claim 12, wherein the at least one criteria is the corresponding average/peak ratio value being an extreme one of the corresponding average/peak ratio values.

15. The apparatus of claim 12, further comprising:

a limiter, coupled to the second phase-shifter and adapted to amplitude limit the second phase-shifted audio signal; and a variable gain amplifier, coupled between the limiter and the transducer and adapted to amplify the amplitude limited audio signal from the limiter, wherein:

the transducer is a loudspeaker; and the processor is adapted to control the gain of the variable gain amplifier.

16. The apparatus of claim 12, wherein the processor is adapted to vary the first phase-shift amount in steps.

17. The apparatus of claim 12, further comprising one or more detectors adapted to generate an average value and a peak value of the first phase-shifted audio signal.

18. The apparatus of claim 17, wherein the one or more detectors comprise:

a peak-value detector adapted to generate the peak value of the first phase-shifted audio signal; and an average value detector adapted to generate the average value of the first phase-shifted audio signal.

19. The apparatus of claim 12, wherein the first phase-shifter comprises a plurality of fixed phase-shifters that are adapted to be selectively coupled in different combinations to provide the plurality of phase-shift amounts in response to the processor.

20. The apparatus of claim 19, wherein the first phase shifter is adapted to provide the plurality of phase-shift amounts in a Gray code sequence in which only a single fixed phase-shifter is changed between each consecutive pair of combinations of the fixed phase shifters.

21. The apparatus of claim 12, wherein the first phase-shifter comprises a programmable all-pass filter adapted to provide the plurality of phase-shift amounts in response to the processor.

* * * * *